United States Patent [19]

Meserow et al.

[11] Patent Number: 4,485,374

[45] Date of Patent: Nov. 27, 1984

[54] NON-WIRED PERIMETER PROTECTIVE SYSTEM

[75] Inventors: Francis P. Meserow, 2605 W. Armitage Ave., Chicago, Ill. 60647; Frank H. Mills, Chicago, Ill.

[73] Assignee: Francis P. Meserow, Chicago, Ill.

[21] Appl. No.: 466,482

[22] Filed: Feb. 15, 1983

Related U.S. Application Data

[63] Continuation-in-part of Ser. No. 159,511, Jun. 16, 1980, abandoned.

[51] Int. Cl.³ ..... G08B 13/08

[52] U.S. Cl. ..... 340/541; 340/529; 340/531; 340/538; 340/545

[58] Field of Search ..... 340/531, 538, 541, 545, 340/529; 455/226, 222, 218; 116/95, 85

[56] References Cited

U.S. PATENT DOCUMENTS

| | | | |
|---|---|---|---|
| 2,463,832 | 3/1949 | Verkuil | 116/95 |
| 2,465,655 | 3/1949 | Miller | 116/95 |
| 2,821,955 | 2/1958 | Ehlers et al. . | |
| 2,821,956 | 2/1958 | Wold . | |
| 3,017,849 | 1/1962 | Grossenheider . | |
| 3,118,423 | 1/1964 | Schmid . | |
| 3,164,127 | 1/1965 | Schmid . | |
| 3,218,556 | 11/1965 | Chisholm | 455/218 |
| 3,327,679 | 6/1967 | Inman . | |
| 3,895,599 | 7/1975 | Berkowitz | 116/95 |
| 3,925,763 | 12/1975 | Wadhwani et al. | 340/538 |
| 3,956,743 | 5/1976 | Geiszler et al. | 340/538 |
| 3,973,250 | 8/1976 | Uffelman | 340/545 |
| 4,121,293 | 10/1978 | Kerr et al. | 340/529 |
| 4,203,096 | 5/1980 | Farley et al. | 340/538 |

*Primary Examiner*—Glen R. Swann, III

*Attorney, Agent, or Firm*—Clement and Ryan

[57] ABSTRACT

A burglar alarm system of the non-wired perimeter protective type for detecting and indicating break-ins at an entrance or opening, such as a window or door, of a building, employs as a sonic signal generator a transducer that is both triggered and powered by the break-in. The sonic signal is of a specific selected supersonic frequency and is received by a remotely located local receiver within the building which in turn may actuate an alarm. Protection against false activation by sonic noise is provided by altering the gain of the receiver in response to received sonic noise adjacent to but different from the selected frequency, so that noise containing even a strong signal at the selected frequency, as well as at adjacent frequencies, does not result in an alarm being raised, but a weaker signal at the selected frequency, without signals at adjacent frequencies, such as is produced by the transducer, does result in an alarm being activated.

11 Claims, 11 Drawing Figures

NON-WIRED PERIMETER PROTECTIVE SYSTEM

CROSS-REFERENCE TO A RELATED APPLICATION

This application is a continuation-in-part of applicants' co-pending application for patent filed June 16, 1980 and assigned Ser. No. 159,511, now abandoned.

FIELD OF THE INVENTION

The present invention is concerned in general with burglar alarm systems; and, in particular, with non-wired, perimeter protective systems for detecting the unauthorized opening of peripheral entranceways, such as gates, doors and/or windows.

BACKGROUND OF THE INVENTION

There are many burglar alarm systems presently available on the market. Some of the oldest of such systems use point-to point wiring, both for opening detection purposes, and for operating the alarms responsive to such detection. Such point-to-point wiring is costly and cosmetically defacing.

Some of the newer burglar alarm systems, therefore, use entranceway opening detection devices that transmit radio frequency signals to a remote receiver which enables an alarm.

The radio frequency-utilizing burglar alarm systems also have certain definite drawbacks. For example, these detecting devices, generally, are battery powered to enable the generation of radio frequency signals responsive to unauthorized openings of the entranceways. Batteries have limited life spans; and therefore, require either special circuitry for automatically checking the power output of the batteries, or periodic checks have to be manually accomplished. Indeed, battery checking and maintenance all too often are neglected with such devices resulting in their uselessness. Such battery operated devices, for the most part, operate through a constantly generated signal while the doors and windows are open which even more so wears the batteries.

In addition, the receiving devices, being in the radio spectrum, are inherently susceptible and operation responsive to spurious radio signals that are either of the same frequency or subharmonics and harmonics of the operating frequency; and therefore, the prior art radio frequency utilizing burglar alarm systems are prone to give "false alarms."

Many attempts have been made to eliminate the "false alarm" problem. The "false alarms" tend to cancel the effectiveness of a burglar alarm system, while presenting the potential for a needless traumatic experience.

Accordingly, an object of the present invention is to provide new and unique burglar alarm systems which are practically immune to "false alarm" due to spurious signals. "Spurious signals" in this application means signals which are generated by means not associated with the burglar alarm system, but nonetheless, capable of causing the alarm to be operated.

A further object of the present invention is to provide burglar alarm systems wherein the unauthorized opening of an entranceway is signaled by mechanical transducers, thereby freeing the actual opening detection system from the need for electrical power, battery or otherwise.

Another and related object of the present invention is to provide one or more mechanical transducers for such burglar alarm systems which generate signals of predetermined frequency.

Yet another object of the present invention is to provide receivers, such as sonic receivers, equipped to receive only signals of the noted predetermined frequency and to reject all other signals.

Still another and related object of the present invention is to provide a superheterodyne sonic receiver with improved means for accepting and distinguishing desired signals which are used to enable a radio frequency generator, or other device as an integral part of the burglar alarm system. This receiver has means and circuitry of such a nature that prevents any spurious signals from activating the unit and causing false alarms.

Still another object of the present invention is to provide means for transmitting the radio frequency signals over power lines to a remote radio frequency receiver for operating alarm means.

Yet another object of the present invention is to provide means associated with the radio frequency generators and receivers for further protecting the system from spurious signals.

SUMMARY OF THE INVENTION

The above mentioned and other objects and features of the present invention are achieved in a preferred embodiment of the Non-Wired Perimeter Protection System. The system comprises mechanical transducers attached to the windows and doors so as to produce sonic signals, if any of the windows or doors are opened without authorization. A superheterodyne sonic receiver, provided with a narrow frequency range microphone, is located in the same or adjacent room or enclosure as are the transducers. The receiver accepts the sonic signals and mixes them with signals provided by local oscillators.

A squelch circuit, including a notch filter, is used in addition to circuitry tuned to the sonic frequency to squelch and reject unwanted spurious frequencies which enable the desired signals to be used to generate or trigger enabling signals that actuate the radio frequency oscillator.

This improved squelch circuit, by so effectively distinguishing and rejecting spurious signals, allows the sonic microphones with their associated circuitry to operate with a high degree of gain to sensitize the receiving capabilities of the system while extending the effective "pick-up" area coverable by the system.

the radio frequency oscillator is coupled through the building power lines to a remote receiver. Since these existing power lines are confined closely together in metal conduit piping, this proximity tends to cancel spurious signals from being picked up. The shielding of the metal conduit further contributes to the shielding effect, and these factors coupled with the comparatively low frequency employed in this section of the system all combine to reject spurious radio frequency signals.

The remote receiver further includes circuitry for preventing "false alarms." Thus, there are provided a burglar alarm system that mechanically generates sonic signals that are not subject to battery failure. The sonic receivers effectively block spurious signals; and finally, the remote receiver also includes circuitry to prevent "false alarms."

Thus, through the two media employed, intelligence is conveyed from the location of entry to a remote location of the alerting unit without installing additional wires, etc.

BRIEF DESCRIPTION OF THE DRAWINGS

The operation and utilization of the present invention will be more apparent from a description of preferred embodiments of the invention taken in conjunction with the attached drawings, in which.

GENERAL DESCRIPTION

Figure 1:
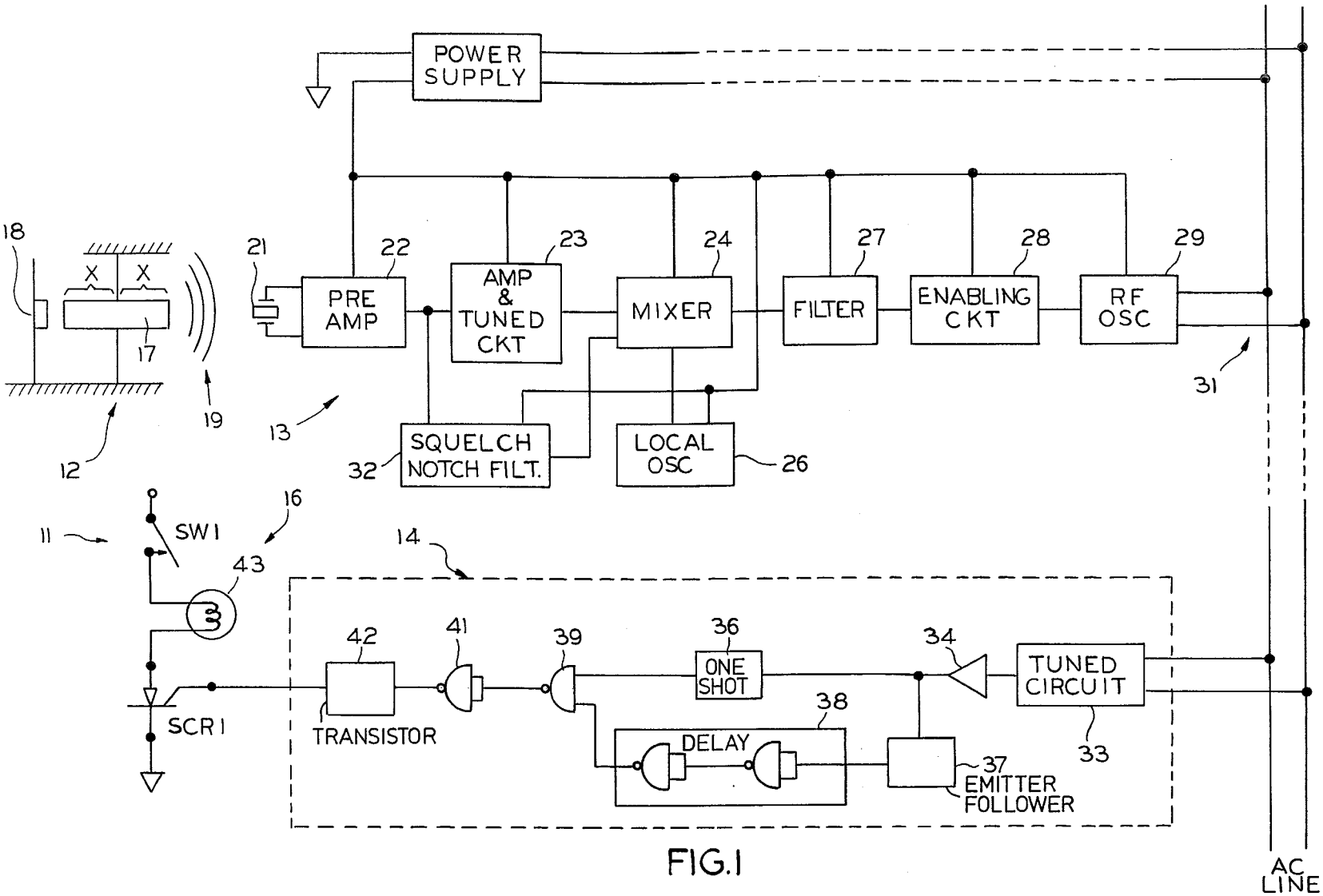
FIG. 1 is a block diagram of a non-wired perimeter protective burglar alarm system.

The non-wired perimeter protective burglar alarm system 11 shown in FIG. 1 includes a transducer 12, a master supersonic receiver 13, a remote radio receiver 14, along with an alarm device indicated at 16. All of the above enumerated components cooperate to provide an alarm system that is extremely reliable, versatile, effective and almost incapable of being tripped by spurious signals. Its versatility enables it to be used on strong boxes, safes, or the like, in addition to entranceways.

The transducer 12 indicated in FIG. 1 is mechanically operated responsive to the illicit or unauthorized opening of an entranceway. A "Duralumin" rod is supported at its center point; i.e., x=x, by suitable means that are designed to prevent the dampening of natural vibrations in the rod.

A spring loaded hammer 18 is positioned and mounted so as to strike the rod 17, when the entranceway is opened without authority. The hammer 18 immediately retracts to prevent dampening the vibrations of the rod induced by the blow. One example of a transducer of this type, including a spring loaded hammer that retracts immediately upon striking an acoustic rod, is illustrated in the accompanying drawings and described below in this specification.

The material, dimensions and mounting of rod 17 are designed to generate supersonic signals 19. Transducers of this type, although for other applications, are disclosed in U.S. Pat. Nos. 2,821,955; 2,821,956; 3,017,849; 3,118,423; 3,164,127 and 3,327,679. In a preferred embodiment these signals are 37.75 KH.

Within the enclosure and/or the range of the transducer generated supersonic signal is the master receiver.

Means are provided for assuring that only the transducer signals activate the supersonic receiver. More particularly, the master receiver uses what is basically a superheterodyne circuit, among other things. The signal generated by the transducer 19 is picked up by a narrow frequency range microphone 21. The supersonic range of the microphone immediately eliminates some of the spurious signal problems.

The electrical signal from the microphone passes through a preamplifier 22 to a tuned amplifier circuit 23 tuned for the 37.75 KH supersonic signal generated by the transducer. The output of the tuned amplifier goes to a mixer circuit 24 where it is mixed with an electrical signal from a local oscillator 26. In a preferred embodiment the frequency of the local oscillator signal is 41.25 KH. Thus, the frequency of the electrical output signal from mixer 24 is 3.5 KH.

Active filter means 27 isolate this frequency and use it in an enabling circuit 28 to provide an electrical signal to activate a radio frequency oscillator 29 (175 KH). The output of the radio frequency oscillator is coupled through the regular house power lines 31 to the remote receiver 14.

Means are provided, if desired, for disabling the mixer circuit responsive to supersonic signals other than the 37.75 KH signal of the transducer. More particularly, supersonic signals other than 37.75 KH are squelched by the squelch circuit 32 equipped with a filter notched at 37.75 KH.

The remote receiver 14 is merely plugged into the house wiring in the same manner as the supersonic master receiver 13. Thus, no complicated wiring is required to install and operate the burglar alarm system. Also, the house or building wiring is normally enclosed in metal conduits that provide shielding from radio frequency interference.

A tuned circuit 33 couples the radio frequency signal—in a preferred embodiment 175 KH—to a preamplifier 34. The output of the amplifier 34 actuates a one shot multi-vibrator 36.

Means are provided for preventing any short period radio signals from interfering with the circuit or triggering "false alarms." More particularly, the one shot multi-vibrator has a relatively long built in delay. Also, the output of the preamplifier 34 is coupled through an emitter follower circuit 37 to a delay circuitry 38 having a relatively short delay. The ouput of both the one shot multivibrator and the delay circuitry is fed to a NAND gate 39. Spurious, short term signals would provide only a single high to the NAND gate from the emitter follower and the NAND gate 39 would not provide an operating signal. Since the actual radio frequency signal is continuous, two signals are received at the NAND gate; i.e., the output of both multi-vibrator 36 and delay circuit 38. So, the gate 39 provides a high at its output which is inverted by inverter 41 and fed through a control transistor 42 circuit to the gate of SCR1 used to complete an operating circuit to an alarm indicated by lamp 43. A reset switch SW1 is used to break the alarm circuit and reset the alarm.

Figure 2:
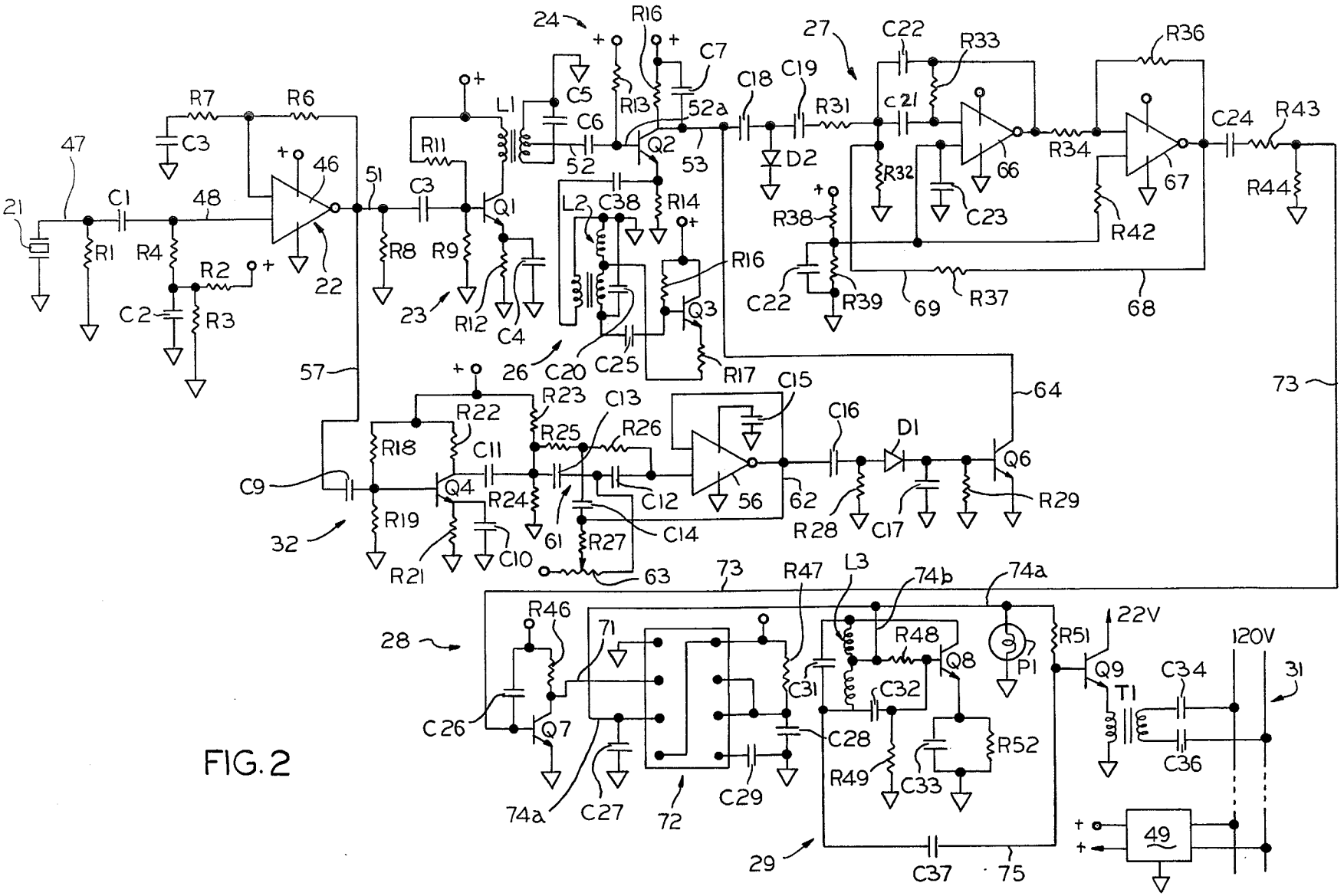
FIG. 2 is a schematic showing of the master receiver shown in block diagram form in FIG. 1.

In FIG. 2 the narrow band microphone 21 is shown coupled to the preamplifier circuitry 22. The heart of the preamplifier circuit is operational amplifier 46. The microphone 21 is coupled through conductor 47, capacitor C1 and conductor 48 to the positive input of amplifier 46. Resistor R1 bridges the microphone, extending from conductor 47 to ground.

Positive voltage is extended from the power supply, indicated as block 49, through the voltage divider comprised of resistors R2 and R3. The junction of resistor R2 and R3 is coupled to conductor 48 through resistor R4. Capacitor C2 bridges resistor R3 passing noises to ground.

Feedback resistor R6 extends from the output of amplifier 46 to the negative input of the amplifier. The negative input is also coupled to ground through the series connection of resistor R7 and capacitor C3.

Positive voltage is attached to terminal 7 of the operational amplifier. Ground is coupled to amplifier 46 at terminal 4. The output of the preamplifier is coupled to the tuned amplifier 23 over conductor 51 coupling capacitor C3 to the base of transistor Q1. The tuned amplifier comprises NPN transistor Q1 and associated circuitry. Matching resistor R8 extends from conductor 51 to ground. The base of transistor Q1 is attached to ground through resistor R9. Resistor R9 is part of a voltage divider circuit extending from positive voltage through resistor R11.

The collector of transistor Q1 is coupled to positive voltage through a first winding of inductor L1. The emitter of transistor Q1 is connected to ground through resistor R12 paralleled by filter capacitor C4.

The tuned circuit is in another or secondary winding of inductor L1. The secondary winding is bridged by capacitor C5, which in a preferred embodiment tunes the secondary winding to 37.75 KH. The signal from preamplifier circuit 22 is amplified and filtered in circuit 23. The 37.75 KH signal is selected by the tuned circuit and amplified by transistor Q1.

The tuned circuit 23 is coupled to the mixer 24. The amplified and filtered signal is coupled to the base of transistor Q2, which is the heart of the mixer circuitry 24, over a circuit that extends from the approximate midpoint of the secondary winding of inductor L1 through conductor 52 coupling capacitor C6, conductor 52*a* to the base of NPN transistor Q2.

The base of transistor Q2 is coupled to positive voltage through biasing resistor R13; while the emitter is coupled to ground through resistor R14. The collector of transistor Q2 is coupled to positive voltage through resistor R16 bridged by filter capacitor C7. The 37.75 KH supersonic signal would appear at the collector; however, means are provided for mixing the supersonic signal with a signal generated by local oscillator 26.

The local oscillator 26 comprises NPN transistor Q3. The base of transistor Q3 is coupled to positive voltage through resistor R16. The collector of the transistor Q3 is coupled directly to positive voltage. The base is also coupled through capacitor C25 to a tuned tank circuit comprising inductor L2 having a winding bridged by capacitor C20. A feedback circuit from the tank extends from the emitter of transistor Q3 through coupling resistor R17 to the approximate midpoint of the bridged winding. The bridged winding is shown grounded at the top end. A second winding of inductor L2 is grounded at the top end and inductively linked to the first winding. The second winding is coupled to the emitter of transistor Q2 through capacitor C38. In a preferred embodiment the local oscillator frequency is 41.25 KH. An output frequency of the mixer circuit is thus 3.5 KH.

Means such as circuit 32 are provided for squelching signals outside of a range around 37.75 KH. The squelch circuit comprises transistors Q4 and Q6, as well as operational amplifier 56, as active elements. The output of operational amplifier 46 is coupled to the base of NPN transistor Q4 through conductor 57 and coupling capacitor C9. The base of transistor Q4 is connected to positive voltage through a divider circuit comprising resistors R18 and R19 connected between positive voltage and ground. The emitter of the transistor is coupled to ground through resistor R21 bridged by filter capacitor C10. The collector of the transistor, here used as a preamplifier, is coupled to positive voltage through load resistor R22. The amplified signal received from preamplifier 22 is coupled to an active notched filter arrangement 61 through coupling capacitor C11.

The filter is a relatively broad band filter notched at 37.75 KH in a preferred embodiment. The filter arrangement comprises the voltage divider made up of resistors R23, R24 coupled between positive voltage and ground. Capacitor C11 is coupled to the junction of resistors R23, R24. The positive input of operational amplifier 56 is also coupled to the junction of resistors R23, R24 through capacitors C12, C13 in series bridged by resistors R25, R26 in series. The output of operational amplifier 56 is coupled directly to the negative input of amplifier 56 and also to the positive input over a circuit that includes conductor 62, the junction of capacitor C14 and resistor R27. The other side of resistor R27 is coupled to the wiper of potentiometer 63 through the potentiometer to the junction of capacitors C12, C13. The other side of capacitor C14 is coupled to the junction of resistors R25, R26.

The drawings show positive voltage coupled to terminal 7 bridged by filter capacitor C15 and ground coupled to terminal 4 of the amplifier 56.

The output of the operational amplifier is an alternating signal within the filter range notched out around a first predetermined frequency; i.e., 37.75 KH for the preferred embodiment. Thus, noises or spurious signals, excluding the values within the notch, provide an output at operational amplifier 56.

The output of amplifier 56 is used to actuate transistor Q6 to squelch the output of the mixer 24. More particularly, the output of amplifier 56 is coupled through capacitor C16 and diode D1 to the base of NPN transistor Q6. The junction of the capacitor C16 and diode D1 is coupled to ground through resistor R28. The junction of the diode D1 and the base of transistor Q6 is coupled to ground through resistor R29 bridged by filter capacitor C17. The base of transistor Q6 thus receives a rectified signal which vastly increases the conduction therethrough.

The emitter of transistor Q6 is coupled directly to ground; while the collector is coupled directly to the output of the mixer circuit 24 over conductor 64 grounding that output, if transistor Q6 is actuated to conduct.

Normally, the difference frequency signal from the mixer (in this example 3.5 KH) is coupled to the active difference frequency filter circuit 27.

More particularly, the active filter is comprised of operational amplifiers 66 and 67. The collector of the mixer is coupled to the negative input of operational amplifier 66 through a circuit that includes in series capacitor C18, capacitor C19, resistor R31 and capacitor C21. The junction of capacitors C18, C19 is coupled to ground through diode D2, leaving the negative portions of the signal at the input of amplifier 66. The junction of resistor R31 and capacitor C21 is connected to ground through resistor R32.

A feedback signal is coupled from the output of amplifier 66 through resistor R33 to the junction of capacitor C21 and the negative input to amplifier 66 and through capacitor C22 to the junction of resistor R31 and capacitor C21.

The output of amplifier 66 is coupled to the negative input of operational amplifier 67 through resistor R34. Operational amplifier is bridged by resistor R36. The output of operational amplifier 67 is fed back to the negative input of operational amplifier 66 over a circuit that includes conductor 68, resistor R37 and conductor 69 to the junction of resistors R31, R32 and capacitors C21.

The positive inputs of the operational amplifiers are coupled to positive voltage over circuitry that goes from positive voltage through voltage divider circuitry including resistors R38, R39 to ground. Resistor R39 is bridged by filter capacitor C22. The junction of resistors R38, R39 is coupled to the positive input of amplifier 66. The junction of resistor R41 and the positive input terminal is connected to ground through filter capacitor C23. The junction of resistors R38, R39 is coupled to the positive input of amplifier 67 through resistor R42. The output of circuit 27 is a 3.5 KH signal.

The output of circuit 27 is coupled to the input of enabling circuit 28 over a coupling circuit that includes capacitor C24, resistor R43 and conductor 73 to the base of NPN transistor Q7. The junction of resistor R43 and conductor 73 is attached to ground through resistor R44.

Transistor Q7 in cooperation with a timer circuit 72 comprise the enabling circuit 28. The enabler circuit 28 uses a timer to delay the operation of the radio frequency oscillator circuit 29.

The base of transistor Q7 is coupled to positive voltage through capacitor C26. The emitter is tied directly to ground. The collector is coupled to positive voltage through resistor R46.

The transistor Q7 operates responsive to the signals from filter circuit 27 to provide operating signals to timer 72. More particularly, the output of transistor Q7 at the collector thereof is connected to terminal 2 of the timer over conductor 71. In a preferred embodiment the timer is a National Semiconductor circuit NC 555 or equivalent. Terminal 1 is grounded. The output is obtained at terminal 3 which also has filter capacitor C27 attached to conductor **74*a*. The other side of the filter capacitor is grounded. Terminal 4 is attached to terminal 8** which also has positive voltage attached thereto.

The timing components, i.e., resistor R47 and capacitor C28, are attached in series between terminal 8 and ground. Terminals 6 and 7 are tied to the junction of resistor R47 and capacitor C28. Capacitor C29 couples terminal 5 to ground.

The output terminal 3 is coupled to the base of radio frequency oscillator transistor Q8 over conductors **74*a*, 74*b* and resistor R48. The oscillator enabling signal on conductor 74*a* occurs a time period after the signal on conductor 71. The time period is determined by the values of resistor R47 and capacitor C28**.

The signal on conductor **74*b* is a positive voltage used to supply power to transistor Q8 and lamp P1. The signal on conductor 74*a* is coupled to the base of emitter follower transistor Q9 through resistor R51**.

The oscillator tank comprises inductor L3 paralleled by capacitor C31. The junction of conductor **74*a* and resistor R48 is connected to the approximate midpoint of the winding of inductor L3. The junction of the bottom inductor L3 and capacitor C31 is coupled to the base of transistor Q8 through capacitor C32. Further, the base of the transistor is connected to ground through resistor R49**.

The emitter of transistor Q8 is connected to ground through resistor R52 bridged by capacitor C33. A pilot lamp P1 is shown coupled between conductor **74*a*** and ground.

The bottom of the tank circuit is coupled to the base of the emitter follower transistor Q9 over conductor 75 and capacitor C37. The collector of transistor Q9 is connected to high positive voltage (i.e., higher than the other positive voltages as indicated by the arrow).

The emitter of transistor Q9 is connected directly to ground through the primary winding of transformer T1. The secondary winding of transformer T1 is coupled through capacitors C34 and C36 to the regular 120 volt power lines of the house or enclosure. Thus, the radio frequency signal from oscillator 29 is inductively and capacitively coupled to the power lines and the radio signal indicating unauthorized ingress is transmitted over wiring in conduit.

Figure 3:
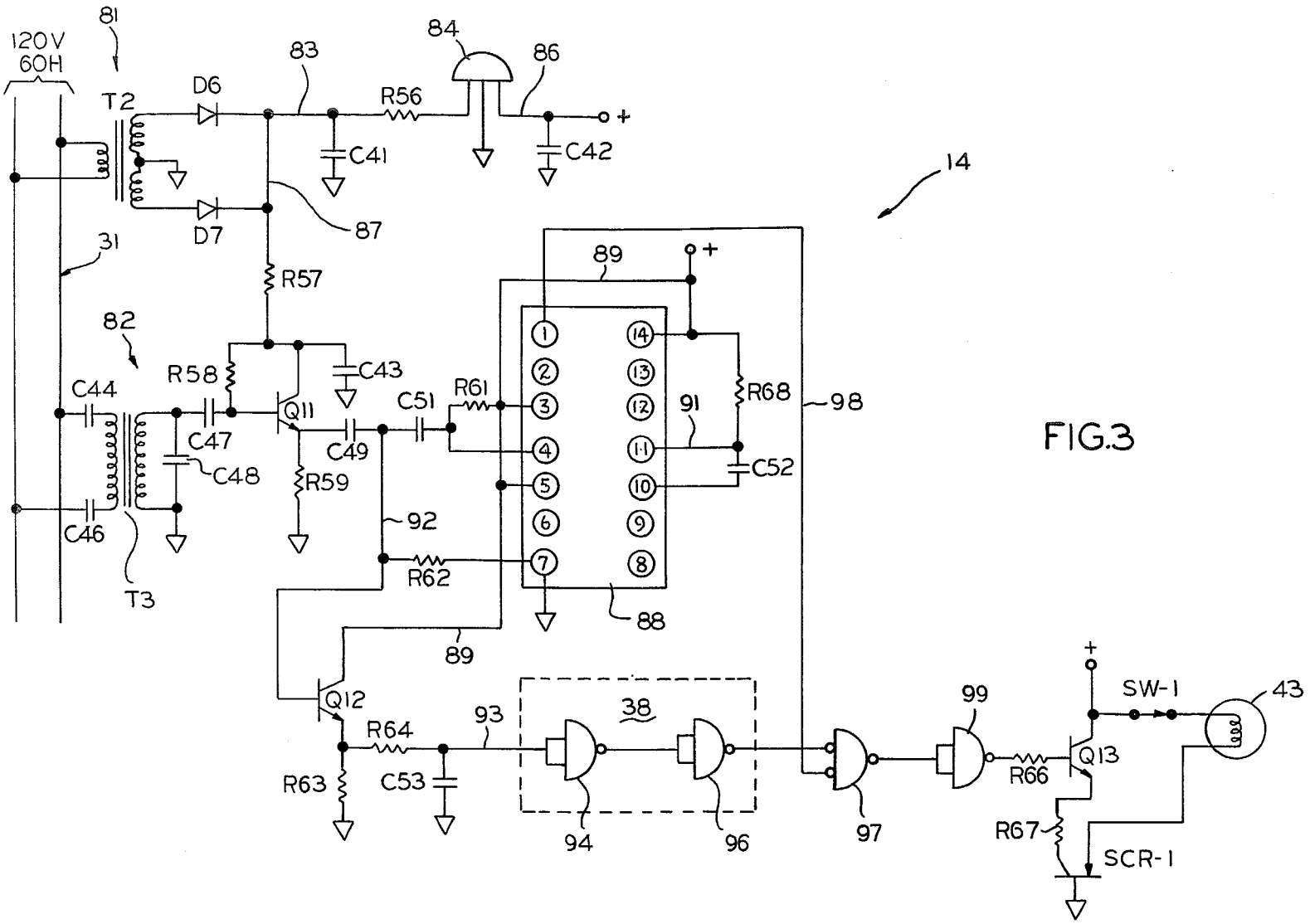
FIG. 3 is a schematic showing of the remote receiver of FIG. 1.

The remote receiver is coupled to the same power lines 31 as is the sonic receiver and radio frequency oscillator circuitry. As shown in FIG. 3, the remote receiver includes a power supply portion 81 and a receiver portion 82. The power supply portion comprises a transformer T2 having its primary coupled to the power lines which are normal 120 Volt, 60 Hertz power lines in a building. The power lines are indicated as 31. The secondary of transformer T2 has one side coupled through diode D6, conductor 83, resistor R56 and regulator circuitry 84 to the normal, positive output indicated with the plus sign.

A capacitor C41 is connected between conductor 83 and ground. A capacitor C42 is connected between conductor 86 and ground. Conductor 86 connects the regulator circuit 84 to the positive terminal. The bottom of the secondary winding is coupled through diode D7 to conductor 87. Conductor 87 couples the cathodes of diodes D6 and D7 together. It also provides positive voltage to a preamplifying transistor Q11 in the receiving portion 82 of the remote receiver 14. More particularly, the conductor 87 connects the positive voltage through resistor R57 and resistor R58 to the base of NPN transistor Q11.

In addition, the junction of resistor R57 and resistor R58 is connected directly to the collector of transistor Q11. The junction of resistors R57, R58 is also connected to ground through filter capacitor C43. The emitter of preamplifying transistor Q11 is connected through resistor R59 to ground.

A transformer T3 is used to couple the base of transistor Q11 to the power lines. More particularly, the primary winding of the transformer T3 is coupled through capacitors C44 and C46 to the power line 31. The secondary winding of transformer T3 has one side coupled directly to ground and the other side coupled through capacitor C47 to the base of transistor Q11. Thus, transistor Q11 is conductively and capacitively coupled to receive the radio frequency signals placed on the power line by the sonic receiver circuitry 13 which includes the radio frequency oscillator 29.

The secondary winding of transformer T3 is tuned by capacitor C48 bridging that winding. In the preferred embodiment described herein, it is tuned to the 175 KH signal which the radio frequency oscillator 29 transmits through the power lines 31.

The output of transistor Q11 takes a pair of paths. One path for the output is through the circuitry that includes coupling capacitor C49 in series with coupling capacitor C51 coupled to a one shot multi-vibrator. More particularly, the other side of capacitor C51 is coupled directly to terminal 4 of a one shot multi-vibrator 88 and to terminal 3 of the one shot multi-vibrator through resistor R61.

The one shot multi-vibrator is connected to positive voltage through conductor 89 which is connected to terminals 3 and 5. Terminal 7 of the one shot multi-vibrator 88 is connected to ground.

Means are provided for delaying the signal from the one shot multi-vibrator. More particularly, timing elements comprising resistor R68, and capacitor C52 are connected in series between terminals 14 and 10 of the one shot multi-vibrator 88. Terminal 14 of the one shot multi-vibrator is also coupled to positive voltage. Terminal 11 of the one shot multi-vibrator is coupled to the junction of resistor R62 and capacitor C52 through conductor 91.

An output from transistor Q11 is also coupled to an emitter follower transistor Q12. More particularly, the junction of capacitors C49 and C51 are coupled through conductor 92 to the base of transistor Q12. The emitter of transistor Q12 is coupled through resistor R63 to ground. The collector of transistor Q12 is coupled to positive voltage through conductor 89. The conductor 92 is coupled to ground through resistor R62.

The output of emitter follower transistor Q12 is coupled to a delay circuit 38. This delay circuit comprises two gates of a four gate NAND circuit. The two gates 94 and 96 are connected as inverters and act to delay the output of transistor Q12.

The coupling between the emitter of transistor Q12 and gate 94 goes through resistor R64 and conductor 93. Conductor 93 is connected to ground through a filter capacitor C53.

The third NAND gate of the four NAND gates is NAND gate 97. It has one of its inputs connected to the delayed output from NAND gate 96. The other input to NAND gate 97 is the output of the one shot multi-vibrator 88. More particularly, terminal 1 of one shot multi-vibrator 88 is coupled to the other input of NAND gate 97 through conductor 98.

Since the output of the multi-vibrator is delayed by the length of the time determined by components R68 and C52, short period interference signals will not activate NAND gate 97. However, since the signal from the radio frequency oscillator is a sustained signal, it will activate gate 97. That is a signal that comes through the emitter follower. Preferably the radio frequency generator produces a signal for a sustained time period that is substantially equal to at least 17 seconds.

The output of gate 97 is coupled to the fourth NAND gate 99, connected as an inverter. The output of gate 99 is coupled to an output transistor Q13 through resistor R66 to switch that transistor on.

More particularly, the collector of transistor Q13 is connected directly to positive voltage. The emitter of transistor Q13 is connected through resistor R67 to the gate of a switching device, such as SCR1. When transistor Q13 switches on responsive to a positive signal output from gate 99, then the SCR1 switches and power is carried from the positive voltage terminal through recess switch SW1, the alarm 43 (here indicated as a lamp), and through the silicon controlled rectifier SCR1 to ground.

Thus, the tuned circuit also provides means for eliminating alarms due to short period interferences that may be on the power lines. This is done with the delay in the one shot multi-vibrator.

After the alarm goes off, it is possible to reset the alarm by opening switch SW1, a normally closed switch. Opening that switch stops the current flow through the silicon controlled rectifier SCR1 and thereby enables the resetting of the circuitry.

The delay in the one shot multi-vibrator operates to prevent "false alarms." If there is a spurious radio frequency signal on the power lines somehow or other in the 175 KH range, then this is picked up by the amplifier of transistor Q11, transmitted both through the emitter follower amplifier Q12 and the one shot multi-vibrator. The output of the emitter follower is presented to gate 97 in the normal fashion which is merely a slight delay caused by inverters 94 and 96. However, the delay used in the multi-vibrator circuit, in a preferred embodiment approximately 7 seconds, is longer than the life of the spurious interference. Therefore, there is no second signal to gate 97 and no output from gate 97.

Since the radio frequency signal from the oscillator is a sustained signal, then the output from the multi-vibrator, after the delay, causes an output from gate 97 as a consequent operation of the alarm.

Figure 4:
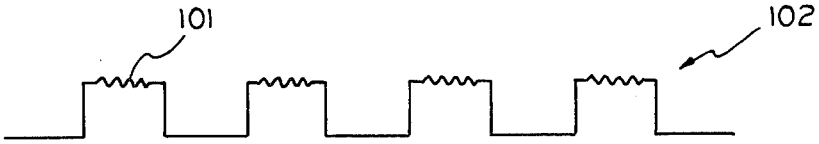
FIG. 4 shows pulses generated by the transducer and is an alternative embodiment of the invention.
Figure 5:
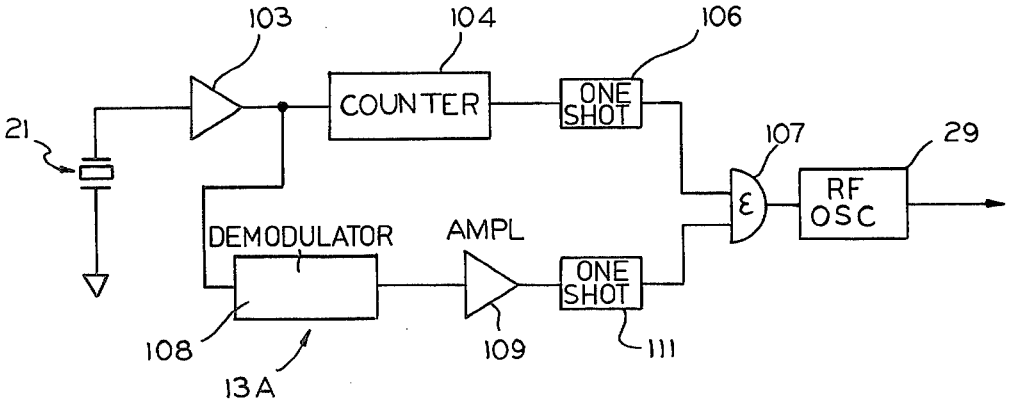
FIG. 5 is a block diagram of the master receiver of the alternative embodiment of the non-wired burglar alarm system.

An alternative method is shown in conjunction with FIGS. 4 and 5. FIG. 4 shows the pulse form of the output of transistor Q12 in the alternative method. Therein a minimum number of pulses 102 modulated as shown by the undulations 101 at the top of the wave is produced by the transducer responsive to the unauthorized opening of an entranceway to the protected enclosure.

The wave form is received by the circuitry shown in FIG. 5. FIG. 5 is a sonic receiver and has a microphone 21 which is connected to a preamplifier 103. The output of the preamplifier is presented to a counter 104 which counts the number of pulses to assure that a minimum number of pulses are present. When the minimum number of pulses is counted, an output multi-counter operates a one shot multi-vibrator 106.

The output of the one shot multi-vibrator goes to an AND gate 107. The other input of the AND gate 107 comes from the circuitry between preamplifier 103 and the AND gate. More particularly, the output of preamplifier 103 also goes to a demodulator filter 108 which demodulates the undulations at the top of the pulse, if they are the proper frequency. This demodulated signal is amplified by amplifier 109.

The output of the amplifier 109 operates an enabling circuit, such as one shot multi-vibrator 111. The output of the one shot multi-vibrator 111 is also connected to AND gate 107. The output of the AND gate occurs responsive to the simultaneous input to the AND gate. This output is used to enable the radio frequency oscillator 29. The output of the radio frequency oscillator is then coupled to the power circuitry in the same manner as radio frequency oscillator 29 of FIGS. 1 and 2.

In the preferred embodiment the components have the following values:

| | | | |
|---|---|---|---|
| R1 = 4.7 | K Ohms | R34 = 193 | K Ohms |
| R2 = 120 | K Ohms | R36 = 969 | K Ohms |
| R3 = 120 | K Ohms | R37 = 489 | K Ohms |
| R4 = 820 | K Ohms | R38 = 120 | K Ohms |
| R6 = 5.6 | Meg Ohms | R39 = 120 | K Ohms |
| R7 = 10 | K Ohms | R42 = 330 | K Ohms |
| R8 = 5.6 | K Ohms | R43 = 3.6 | K Ohms |
| R9 = 10 | K Ohms | R44 = 10 | K Ohms |
| R11 = 150 | K Ohms | R46 = 100 | K Ohms |
| R12 = 270 | Ohms | R47 = 820 | K Ohms |
| R13 = 680 | K Ohms | R48 = 18 | K Ohms |
| R14 = 10 | K Ohms | R49 = 2.7 | K Ohms |
| R16 = 100 | K Ohms | R51 = None | |
| R17 = 820 | Ohms | R52 = 820 | Ohms |
| R18 = 150 | K Ohms | R56 = 300 | Ohms |
| R19 = 10 | K Ohms | R57 = 1 | K Ohms |
| R21 = 820 | Ohms | R58 = 650 | K Ohms |
| R22 = 10 | K Ohms | R59 = 10 | K Ohms |
| R23 = 120 | K Ohms | R61 = 100 | K Ohms |
| R24 = 120 | K Ohms | R62 = 680 | K Ohms |
| R25 = 43.2 | K Ohms | R63 = 1 | K Ohms |
| R26 = 43.2 | K Ohms | R64 = 270 | Ohms |
| R27 = 19.6 | K Ohms | R66 = 100 | K Ohms |
| R28 = 10 | K Ohms | R67 = 10 | K Ohms |
| R29 = 120 | K Ohms | R68 = 33 | K Ohms |
| R31 = 193 | K Ohms | | |
| R32 = 77.5 | Ohms | | |
| R33 = 193 | K Ohms | | |
| Potentiometer 63 = 5K Ohms | | | |

| | | | |
|---|---|---|---|
| C1 = 100 | F | C28 = 10 | F |
| C2 = 220 | F | C29 = 4.7 | F |
| C3 = 0.01 | F | C31 = 470 | F |
| C4 = 4.7 | F | C32 = 100 | F |
| C5 = 820 | F | C33 = 0.1 | F |
| C6 = .001 | F | C34 = 0.18 | F |
| C7 = 120 | F | C36 = 0.18 | F |
| C9 = 0.01 | F | C37 = 120 | F |
| C10 = 4.7 | F | C38 = 120 | F |
| C11 = 0.1 | F | C41 = 100 | F |
| C12 = 100 | F | C42 = 0.1 | F |
| C13 = 100 | F | C43 = 47 | F |
| C14 = 200 | F | C44 = 0.1 | F |
| C15 = 0.1 | F | C46 = 0.1 | F |
| C16 = 0.1 | F | C47 = .001 | F |
| C17 = 0.5 | F | C48 = Part of T3 | |
| C18 = 0.1 | F | C49 = 0.1 | F |
| C19 = 0.01 | F | C51 = 200 | F |
| C20 = 820 | F | C52 = 220 | F |
| C21 = 0.01 | F | C53 = .5 | F |
| C22 = 0.01 | F | D1 = 1N914 | |
| C23 = 0.01 | F | D2 = 1N34 | |
| C24 = 0.1 | F | D6 & 7 = 1N4002 | |
| C25 = 120 | F | Q1 thru Q8 = 2N3566 | |
| C26 = .001 | F | Q9 = 2n6559 | |
| C27 = 0.1 | F | Q11 thru Q13 = 2N3565 | |

Figure 6:
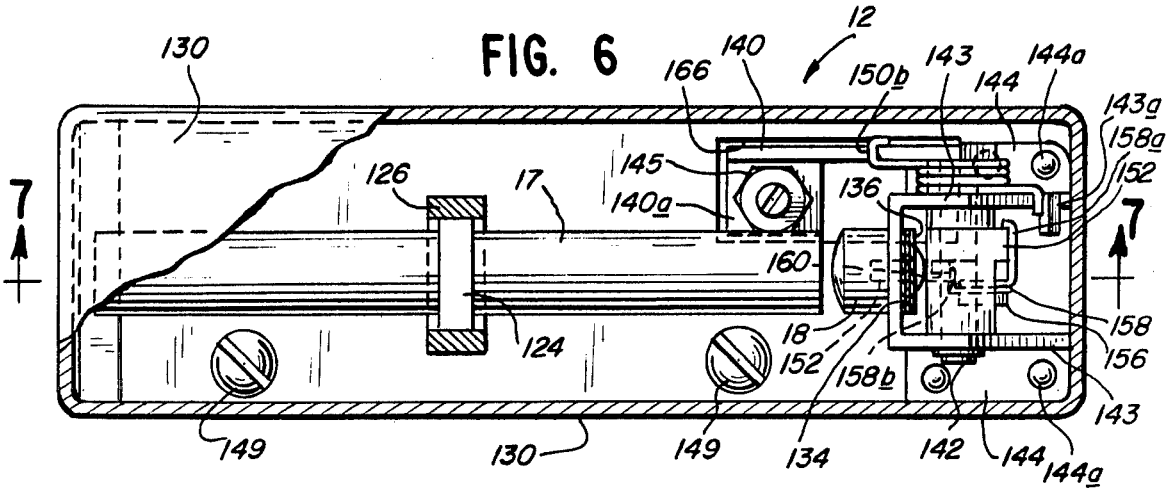
FIG. 6 is a plan view of a transducer used with the protective system of this invention to convert mechanical energy to supersonic sound energy, with the casing broken away to show the operative parts of the transducer.
Figure 7:
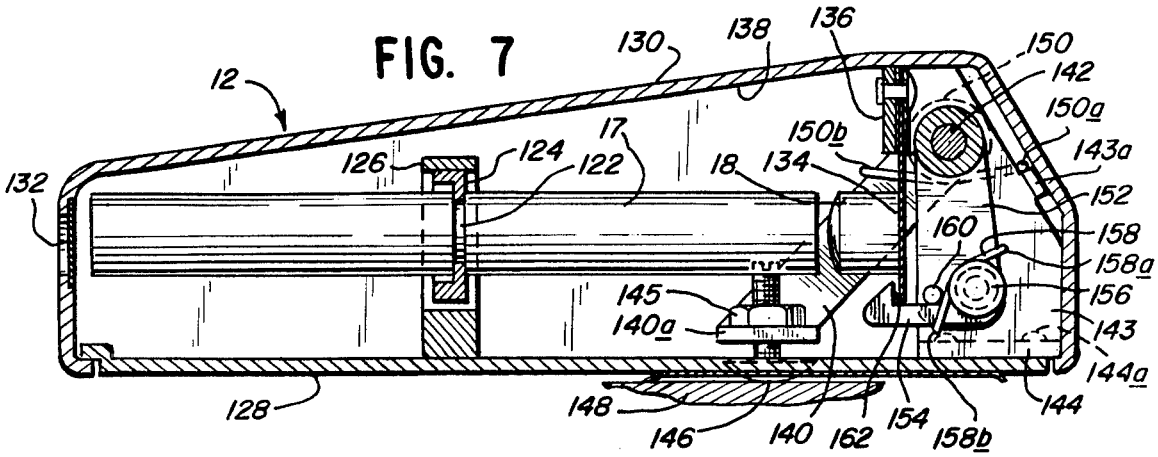
FIG. 7 is a sectional view of the transducer of FIG. 6, taken along the line 7—7 in the latter Figure.

All Op. Amps. in FIG. 1 are CA 3140E
66 & 67; i.e., band pass circuit may be different
T2 = Triad-UTRAD #F153XP
T3 = 175 KH IF Transformer
SCR1 = C107c13 or 2N5061
84 = 78 L05NC
88 = 74121
94–96, 97, 99 are all part of 7400NC As stated above, transducer 12 shown in FIG. 1 is mechanically operated in response to the illicit or unauthorized opening of an entranceway. One example of such a transducer that is mounted on a door to signal any unauthorized opening of the door is shown in FIGS. 6 and 7, with its operation illustrated in FIGS. 8 through 11. FIG. 6 is a plan view of the transducer, with the casing for the operating mechanism broken away to give a clearer showing of that mechanism. FIG. 7 is a cross-sectional view of the transducer of FIG. 6, taken along line 7—7 in the latter Figure.

The construction of transducer 12 can perhaps be best understood if the cross-sectional view shown in FIG. 7 is discussed first. As seen in that Figure, cylindrical acoustic rod 17 is supported at its center point 122 by ring 124, which is attached to support bracket 126. The mode of attachment is designed to prevent the dampening of natural vibrations in the rod. Rod 17 may suitably be formed of a light, strong metal alloy such as the alloy of aluminum and copper, with magnesium and manganese added, that is sold under the trademark "Duralumin."

The acoustic rod is positioned in a protective casing including bottom member 128 and snap-on cover 130. The end of cover 130 seen on the left-hand side of FIG. 7 carries grill 132, through which supersonic signals can easily pass.

Spring loaded hammer 18 is suspended on relatively stiff spring 134 through a suitable attachment 136 carried by underside 138 of cover 130. As explained above, spring loaded hammer 18 is positioned and mounted so as to strike rod 17 whenever the entranceway is opened without authority. The construction of transducer 12 is such that after it strikes rod 17, hammer 18 immediately retracts to prevent dampening the vibrations of the rod that are induced by the blow. The material, dimensions and mounting of rod 17 are designed to generate supersonic signals 19, shown schematically in FIG. 1.

Follower 140 is pivotally mounted on shaft 142, which is journaled in U-shaped supporting bracket 143. Flanges 144 of bracket 143 are secured to bottom member 128 through screws 144*a*.

Bottom flange 140*a* on follower 140 has adjusting nut 145 secured thereto. Adjustable follower stud 146 is threadably engaged with nut 145, so as to be in contact with door frame 148, which serves as the reference point for monitoring the unauthorized opening of the door to which the transducer is attached by means of mounting screws 149 (FIG. 6).

For ease of illustration, in FIGS. 8 through 11 transducer 12 is shown as if it is stationary and as if it is door frame 148 that moves when the door to which transducer 12 is attached is opened. The fact is, of course, that frame 148 is stationary and it is the transducer that moves as the door is opened and closed. The movement of door frame 148 that is shown in FIGS. 8 through 11 is, in other words, relative to the door and the transducer secured to the door, not actual movement relative to the rest of the structure with which the frame is associated.

Adjustable follower 140 is kept biased against door frame 148 by the action of coil spring or drive spring 150. One end 150*a* of the coil spring rests against tab 143*a* extending from supporting bracket 143, and the other end 150*b* of the coil spring is positioned to press normally against follower 140.

Pawl arm 152 is rigidly attached at its upper end to pivot shaft 142 of the adjustable follower, to pivot with the follower as it moves under the force applied by drive spring 150. The lower end of pawl arm 152 carries pawl 154, which is pivotally mounted on the arm at 156.

Pawl 154 is normally urged by pawl spring 158 to pivot upward around pawl pivot 156. One end 158*a* of the pawl spring is engaged with pawl arm 152, and the other end 158*b* is engaged with the underside of pawl 154. With pawl 154 normally biased by the pawl spring against stop 160 carried by pawl arm 152, notch 162 at the free end of the pawl engages the lower end of hammer spring 134 to keep it in a substantially vertical position with hammer 18 at rest.

Figure 8:
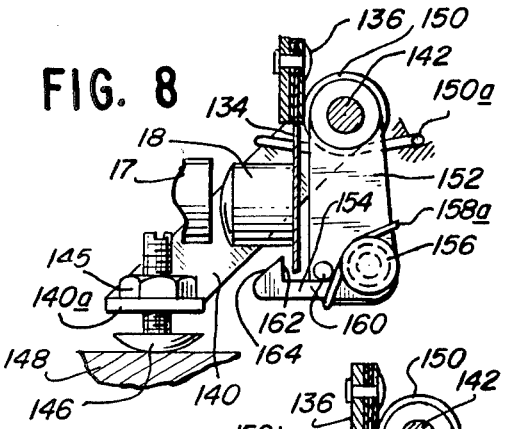
FIG. 8 is a fragmentary view of the transducer at rest, with the entryway with which the alarm system of this invention is used in its closed condition.
Figure 9:
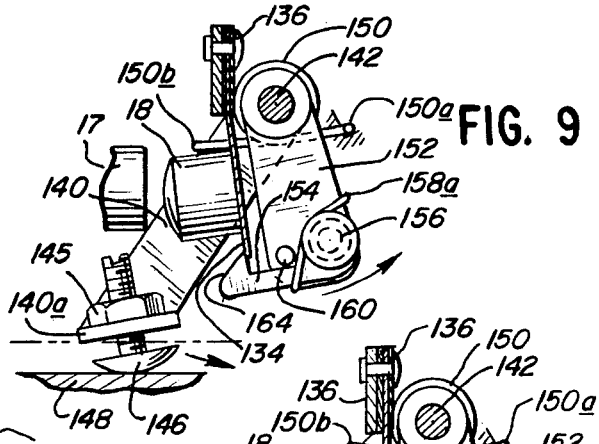
FIG. 9 is a similar view to FIG. 8 but with the transducer moving into its cocked condition while the entryway with which the alarm system of this invention is used is opening.
Figure 10:
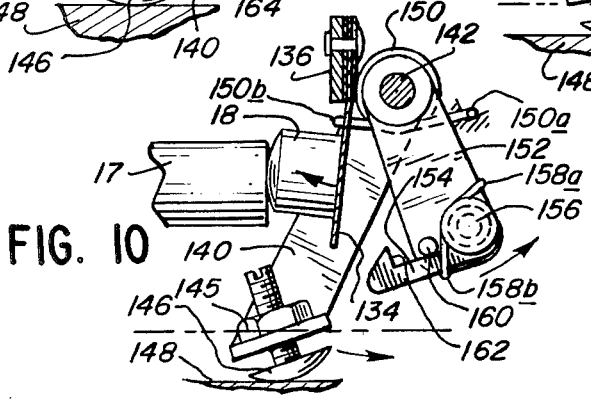
FIG. 10 is a similar view to FIG. 8 but with the transducer shown after it has been triggered by the further opening of the entryway with which the alarm system of this invention is used.

Hammer 18 occupies its rest position, as shown in FIGS. 7 and 8, when adjustable follower stud 146 is held by door frame 148 in its rest position against the urging of drive spring 150. As seen in FIGS. 9 and 10, when the door associated with door frame 148 undergoes an unauthorized opening, follower 140 moves under the urging of drive spring 150 to maintain contact with door frame 148 as the door opens. This moves the follower in a counterclockwise direction as seen in FIG. 9, and that movement moves pawl arm 152 with it in the same direction. As a result, pawl 154, acting through notch 162, pulls hammer spring 134 back into its cocked position.

When the distance between door frame 148 and the door that is swinging open has increased enough to permit follower 140 and pawl arm 152 to move notch 162 of the pawl out of engagement with hammer spring 134, the hammer spring causes hammer 18 to move to the left in FIG. 10 and sharply strike the end of rod 17 to generate the desired supersonic signal.

When hammer 18 strikes acoustic rod 17, substantially all the energy of the hammer is dissipated by transfer to the rod. After the hammer strikes the rod, relatively stiff hammer spring 134 tends to return to its unbiased straight condition in the vertical position that is seen in FIGS. 7 and 8. The weight of hammer 18 also tends to cause the hammer spring to be retracted to its vertical position without further oscillation to any significant extent. As will be seen, the immediate retraction of hammer 18 prevents dampening the supersonic vibrations of rod 17 that are induced by the blow from the hammer.

Figure 11:
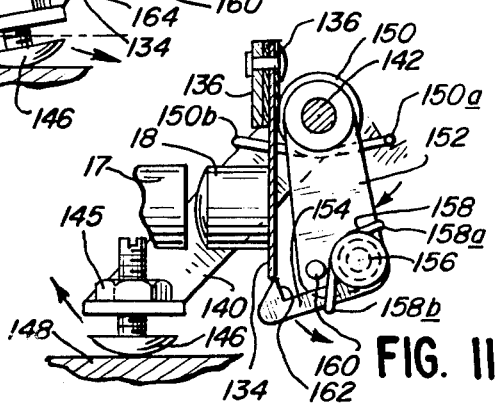
FIG. 11 is a similar view to FIG. 8, with the transducer approaching its rest position as the entryway in question is closing.

FIG. 11 shows the operating parts of transducer 12 just as they are returning the transducer to its rest position. The door is just moving back to where door frame 148 is in the closed or reference position with respect to the door, causing adjustable follower 140 to move clockwise as seen in FIG. 11. As follower 140 moves clockwise, it carries pawl arm 152 with it in the same direction.

This in turn brings sloping edges 164 of pawl 154 into contact with the bottom end of hammer spring 134. The stiffness of the spring and the weight of hammer 18 cause the bottom end of spring 134 to ride up on slope 164 by pushing pawl 154 downward in the counterclockwise direction against the urging of coil spring 158. As soon as the bottom end of hammer spring 134 reaches the top of sloping surface 164, it drops down into notch 162, and follower 140 has at this time moved back into its "at rest" reference position with respect to frame 148. In this condition, all parts of transducer 12 occupy the positions shown in FIGS. 7 and 8.

FIG. 6 gives a plan view of the operating parts of transducer 12. As there seen, opening 166 is provided in bottom wall 128 of the casing of the transducer, to permit adjustable follower 140 to protrude from the casing to be in contact with door frame 148 whenever the door to which transducer 12 is secured is in the closed position, and to move out of the casing and actuate acoustic rod 17, in the manner described above, in response to unauthorized opening of the door.

When transducer 12 is used to signal the unauthorized opening of a window, it may suitably be mounted on the side of the window casing near the bottom of the casing. In such an installation, follower 140 is in contact with the frame portion of the window itself when the window is closed, and when the window is opened the follower moves into the opening left by the opened window. This causes hammer spring 134 to move hammer 18 so as to strike acoustic rod 17 a sharp blow, and the transducer continues its operation as described above.

While the principles of the invention have been described above in connection with specific apparatus and applications of the invention it is to be understood that this description is made by way of example only and not as a limitation on the scope of the claims.

What is claimed is:

1. A non-wired perimeter alarm system of the type that uses the opening of an entryway such as a door or window to institute an alarm at a location removed from the entryway, comprising:

a transducer module capable of being installed at an entryway and including means for generating a supersonic acoustic signal at a first predetermined frequency above the range of human hearing by striking a solid body a single blow to set up undampened vibrations in response to the opening of the entryway, said transducer using the mechanical force resulting from the act of opening the entryway both to trigger said supersonic acoustic signal and to power the transducer's production of said signal; and a local receiver capable of receiving said supersonic acoustic signal of said first predetermined frequency at a location removed from the transducer and for producing an alarm-activating electrical signal in response thereto;

whereby the transducer may be positioned at said entryway of a building, and the local receiver positioned in the interior thereof to raise alarm in response to the transducer's supersonic acoustic signal.

2. The non-wired perimeter alarm system of claim 1 wherein said local receiver includes means for amplifying an electrical signal derived from a received supersonic acoustic signal at said first predetermined frequency and means for decreasing or stopping false alarm activations by sonic noise, which sonic noise contains noise at said first predetermined frequency sufficient to otherwise cause the local receiver to produce said alarm-activating signal, which false-alarm-decreasing-means contains means for detecting acoustic signals outside of a band of frequencies at said first predetermined supersonic frequency and for altering the gain of said amplifying means for said electrical signal in such a way as to decrease or prevent the production of said alarm-activating electrical signal, when such outside-of-the-band acoustic signals are detected at a significant level.

3. The alarm system of claim 2 for use in a building having power lines, which system includes one local receiver, one remote receiver, and no other receivers, wherein:

(a) said local receiver includes:

a microphone for converting supersonic acoustic signals, including signals of said predetermined first supersonic frequency, into electrical signals;

means coupled to said microphone for providing an enabling electrical signal in response to said first mentioned electrical signals;

shunting means for preventing passage of electrical signals other than those in a band of frequencies including said first predetermined frequency, said shunting means being coupled to the electrical signal path from said microphone to said enabling signal-providing means, said shunting means comprising a tuned circuit notched at said first predetermined supersonic frequency, said tuned circuit being coupled to said microphone and being operative to prevent said signals other than those in said band of frequencies including said first predetermined frequency from reaching said means for providing an enabling signal;

a transmitter for providing an electrical signal of a predetermined radio frequency as said alarm-activating signal;

enabling circuit means operationally connected to respond to said enabling signal to activate said transmitter means; and means for coupling said electrical signal of a predetermined radio frequency from said transmitter to the power lines of the building; and (b) said remote receiver includes alarm means for raising an alarm, said remote receiver also being coupled to the power lines and operated in response to said predetermined radio frequency signal for activating said alarm means.

4. The system of claim 3 wherein said local receiver includes:

a local oscillator for generating an electrical signal at second predetermined supersonic frequency;

a mixer for mixing said second predetermined supersonic signal with said first supersonic signal to produce a beat frequency at a third predetermined sonic frequency; and filter means coupled to said mixer for filtering out signals outside of said third predetermined sonic frequency and for passing said third predetermined frequency signal, said enabling circuit means comprising timer means coupled to said filter means and operating responsive to said third predetermined sonic frequency signal to activate said transmitter means.

5. The protective system of claim 4 wherein:

a narrow band microphone is used as said microphone; and said means for detecting sonic signals outside of a band of signals at the first-recited predetermined frequency includes a notched filter means notched around the first predetermined frequency connected to receive signals from said narrow band microphone; and means for coupling the output of said notched filter means to squelch the output of said mixer means when there are signals received by said microphone which pass through said notched filter, is provided as said gain-altering means.

6. The system of claim 4 wherein said means for coupling said predetermined radio frequency signals to said power lines comprise inductive and capacitive means; and wherein said timer means maintains said transmitter means operative to provide said alarm activation signal for a sustained time period of at least about 17 seconds.

7. The protective system of claim 6 wherein said means for coupling comprises emitter follower means between said transmitter means and said inductive-capacitive means.

8. The protective system of claim 3 wherein said remote receiver means comprises tuned amplifier circuit means for receiving said radio frequency signal from said power lines;

gate means for providing a signal to cause said alarm means to operate if at least two simultaneous inputs are connected to said gate;

means responsive to said received radio frequency signals for providing a first input to said gate means for as long as said received radio frequency signals continue; and one shot-multi-vibrator means operate responsive to said received radio frequency signals for providing a sustained second input to said gate means after a delay period, whereby said gate means does not provide a signal responsive to short term interference signals.

9. The non-wired perimeter alarm system of claim 1 in which said transducer includes:

(a) a suspended acoustical rod;

(b) a hammer member for striking said rod, said hammer having:

(i) a neutral, ready position, and (ii) a cocked condition from which it can be triggered to strike said acoustical rod; and (c) means for:

(i) cocking said hammer in response to the initial opening of said entryway, and (ii) triggering the hammer upon further opening of the entryway, said rod when struck a single hammer blow vibrating at a natural predetermined supersonic frequency, and said hammer after striking said single blow returning to its neutral, ready condition.

10. The alarm system of claim 9 in which:

(a) said hammer is carried by a spring member tending to return the hammer to its neutral, ready position when it is displaced to either side of said position; and (b) the hammer is mounted;

(i) to be pushed by the initial opening of said entryway into its cocked condition, in which said spring member is bent back, (ii) to be triggered upon further opening of said entryway to release said hammer to strike said acoustical rod, and (iii) to return to said ready position, under urging from said spring member, immediately after striking said rod.

11. In a burglar alarm system of the type employing peripheral modules that send signals of a detected event comprising the opening of an entryway of a building to a local receiver which, in response to such received signals, effectuates the sounding of an alarm, the improvement comprising:

using as peripheral modules a transducer which converts mechanical energy produced by said entryway opening to supersonic sound energy by striking a solid body a single blow to set up undampened vibrations, which supersonic sound serves to signal the event, and whereby the module has an indefinite standby life unlimited by any problem of deterioration of its power supply and may also be re-used indefinitely.

* * * * *